US011208190B1

(12) United States Patent
Waldvogel et al.

(10) Patent No.: US 11,208,190 B1
(45) Date of Patent: Dec. 28, 2021

(54) STERN DRIVES HAVING BREAKAWAY LOWER GEARCASE

(71) Applicant: Brunswick Corporation, Mettawa, IL (US)

(72) Inventors: David J. Waldvogel, Fond du Lac, WI (US); Randall J. Poirier, Fond du Lac, WI (US); John O. Scherer, III, Oshkosh, WI (US); Stephen R. Collins, Fond du Lac, WI (US); Wayne M. Jaszewski, Jackson, WI (US); Kevin M. Moore, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 31 days.

(21) Appl. No.: 16/909,082

(22) Filed: Jun. 23, 2020

(51) Int. Cl.
*B63H 21/30* (2006.01)
*B63H 5/125* (2006.01)
*B63B 43/18* (2006.01)

(52) U.S. Cl.
CPC ..... *B63H 21/30* (2013.01); *B63B 43/18* (2013.01); *B63H 5/125* (2013.01); *B63H 2005/1256* (2013.01); *B63H 2021/307* (2013.01)

(58) Field of Classification Search
CPC .... B63H 5/07; B63H 2005/075; B63H 5/125; B63H 2005/1256; B63H 20/10; B63H 21/30; B63H 21/302; B63H 21/305; B63H 2021/307; B63B 43/18; Y10T 403/11
See application file for complete search history.

(56) References Cited

U.S. PATENT DOCUMENTS 1,822,573 A 9/1931 Gerald et al.
1,843,089 A 1/1932 Peck
1,890,938 A * 12/1932 Fahrney ..... B63H 20/10 440/56

(Continued)

FOREIGN PATENT DOCUMENTS

DE 3519599 1/1986
ES 2544041 8/2015

(Continued)

OTHER PUBLICATIONS

Barron, "Stemdrive Developments", Trailer Boats, May 2006.

(Continued)

*Primary Examiner* — Ajay Vasudeva
(74) *Attorney, Agent, or Firm* — Andrus Intellectual Property Law, LLP

(57) ABSTRACT

A stern drive is for propelling a marine vessel in water. The stern drive has an upper drive unit with a lower mounting surface; a lower gearcase coupled to the lower mounting surface and a trailing end surface that is angled relative to the lower mounting surface; and a propeller shaft extending forwardly from the lower gearcase and being configured to rotate a propeller for pulling the marine vessel in the water. The upper drive unit and the lower gearcase are configured such that when a forward side of the lower gearcase impacts an underwater obstruction, the lower gearcase is caused to pivot relative to the upper drive unit until the trailing end surface impacts the lower mounting surface, which thereby causes the lower gearcase to completely uncouple from the upper drive unit.

19 Claims, 6 Drawing Sheets

(56) References Cited

U.S. PATENT DOCUMENTS

| | | | | |
|---|---|---|---|---|
| 2,091,247 | A * | 8/1937 | Williams, Jr. | B63H 20/02 440/53 |
| 2,616,387 | A | 11/1952 | Kiekhaefer | |
| 2,917,019 | A * | 12/1959 | Krueger | B63H 5/125 440/56 |
| 2,965,065 | A | 12/1960 | Tinker | |
| 2,973,738 | A * | 3/1961 | Ladewig | B63H 20/10 440/64 |
| 3,376,842 | A | 4/1968 | Wynne | |
| 3,534,703 | A | 10/1970 | Ekman | |
| 4,501,560 | A | 2/1985 | Brandt et al. | |
| 4,698,036 | A | 10/1987 | Brandt | |
| 5,439,403 | A | 8/1995 | Rolla | |
| 5,846,103 | A | 12/1998 | Varney et al. | |
| 5,947,779 | A | 9/1999 | Heideman et al. | |
| 5,964,626 | A | 10/1999 | Varney et al. | |
| 6,315,623 | B1 * | 11/2001 | Hedlund | B63B 43/18 440/112 |
| 6,623,320 | B1 | 9/2003 | Hedlund | |
| 7,234,983 | B2 | 6/2007 | Davis | |
| 7,371,140 | B2 | 5/2008 | Davis | |
| 7,435,147 | B1 | 10/2008 | Eichinger | |
| 7,588,473 | B2 | 9/2009 | Beachy Head | |
| 7,614,926 | B2 | 11/2009 | White et al. | |
| 7,666,040 | B2 | 2/2010 | Arvidsson | |
| 7,681,513 | B1 | 3/2010 | Hundertmark | |
| 7,867,046 | B1 | 1/2011 | Eichinger | |
| 8,011,983 | B1 | 9/2011 | Davis et al. | |
| 8,267,731 | B2 | 9/2012 | Arvidsson | |
| 8,430,701 | B2 | 4/2013 | Jegel et al. | |
| 8,579,669 | B2 | 11/2013 | Sjoblom et al. | |
| 9,187,164 | B2 * | 11/2015 | Schlintz | B63B 43/18 |
| 9,266,593 | B2 | 2/2016 | Nutt et al. | |
| 9,481,439 | B1 | 11/2016 | Groeschel et al. | |
| 9,630,692 | B2 | 4/2017 | Hasl et al. | |
| 9,714,071 | B2 * | 7/2017 | McDonald | B63B 43/18 |
| 9,809,289 | B2 * | 11/2017 | Nutt | B63H 20/10 |
| 2006/0223390 | A1 | 10/2006 | Silva et al. | |
| 2014/0179178 | A1 | 6/2014 | Kokkila | |

FOREIGN PATENT DOCUMENTS

| | | |
|---|---|---|
| GB | 937476 | 9/1963 |
| WO | 2005021372 | 3/2005 |
| WO | 2010110703 | 9/2010 |
| WO | 2015031288 | 3/2015 |

OTHER PUBLICATIONS

Baucom, "Tractor Tugs are the Answer", United States Naval Institute. Proceedings; Annapolis vol. 123, Iss. 8, (Aug. 1997).

Bonner, "Naval Propulsion for the 21st Century", The AzipodSystem, United States Naval Institute. Proceedings; Annapolis vol. 125, Iss. 8 (Aug. 1999).

Carlton, et al. "Azimuthing and Podded Propulsors", chapter 15, Marine Propellers and Propulsion, Third Edition. http://dx.doi.org/10.1016/B978-0-08-097123-0.00002-2.

Carlton, et al. "Propulsion Systems", chapter 2, Marine Propellers and Propulsion, Third Edition, http://dx.doi.org/10.1016/B978-0-08-097123-0.00002-2.

Facinelli, et al. "Integrated System Analysis and Design of Podded Ship Propulsors", Marine Technology, vol. 35, No. 3, Jul. 1998.

Husick, "Ode to Joystick Need to Feel Omnipotent? Try Cummins MerCruiser's new Project Zeus", Yachting; New York vol. 199, Iss. 6, (Jun. 2006).

"Marine Engines and Auxiliary Machinery", The Maritime Engineering Reference Book: A Guide to Ship Design, Construction and Operation, Science & Technology, 2008.

"New Propulsion System Uses Pod Drives", Soundings, May 30, 2006, accessed Sep. 20, 2019 via https://www.soundingsonline.com/news/news-propulsion-systems-uses-pod-drives.

"Zeus and the Cummins Inboard Joystick", accessed Sep. 20, 2019 via https://www.cummins.com/engines/zeus-and-cummins-inboard-joystick.

* cited by examiner

STERN DRIVES HAVING BREAKAWAY LOWER GEARCASE

FIELD

The present disclosure relates to stern drives for marine vessels.

BACKGROUND

The following U.S. Patents are incorporated herein by reference in entirety:

U.S. Pat. No. 7,234,983 discloses a marine vessel and drive combination having port and starboard tunnels formed in a marine vessel hull raising port and starboard steerable marine propulsion devices to protective positions relative to the keel.

U.S. Pat. No. 7,435,147 discloses a marine propulsion device provided with a breakaway skeg having first and second attachment points. The first and second attachment points are configured to result in the second attachment points disengaging from a gear case or housing structure prior to the first attachment point. The attachment points can comprise open or closed slots and, when an open slot is used for the first attachment point, it can be provided with a first edge along which a first pin can exert a force along a preselected angle in response to an impact force on the skeg. The arrangement of attachment points allows a reaction force at the second pin to be predetermined in a way that assures the detachment of the skeg from the housing structure prior to the detachment of the housing structure from another structure, such as the boat hull, or transom.

U.S. Pat. No. 7,867,046 discloses a marine drive having a break-away mount provided by hollowed-out threaded fasteners mounting first and second sections of the drive and breaking away in response to a given underwater impact against the second section to protect the first section and the vessel.

U.S. Pat. No. 8,011,983 discloses a marine drive having a break-away mount mounting first and second sections of the drive and breaking-away in response to a given underwater impact against the second section to protect the first section and the vessel.

U.S. Pat. No. 9,481,439 discloses a stern drive for a marine vessel. The stern drive comprises a gimbal housing that is configured for connection to the marine vessel, a gimbal ring that is steerable with respect to the gimbal housing about a vertical steering axis, a driveshaft housing that is connected to the gimbal ring, and a trim actuator that is configured to trim the driveshaft housing about a horizontal trim axis. The trim actuator has a first end that is pivotably connected to the gimbal ring at a horizontal first pivot axis and a second end that is pivotably connected to the driveshaft housing at a horizontal second pivot axis. A resilient driveshaft housing vibration isolator is located along the second pivot axis. The resilient vibration isolator isolates vibration forces on the driveshaft housing. A resilient gimbal ring vibration isolator is located along the trim axis. The gimbal ring vibration isolator isolates vibration forces on the gimbal ring.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples disclosed herein, a stern drive is for propelling a marine vessel in water. The stern drive has an upper drive unit with a lower mounting surface; a lower gearcase coupled to the lower mounting surface and having a trailing end surface that is angled relative to the lower mounting surface; and a propeller shaft extending forwardly from the lower gearcase and being configured to rotate at least one propeller for pulling the marine vessel in the water. The upper drive unit and the lower gearcase are configured such that when a forward side of the lower gearcase impacts an underwater obstruction, the lower gearcase is caused to rearwardly pivot relative to the upper drive unit until the trailing end surface impacts the lower mounting surface, which thereby causes the lower gearcase to completely uncouple from the upper drive unit.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
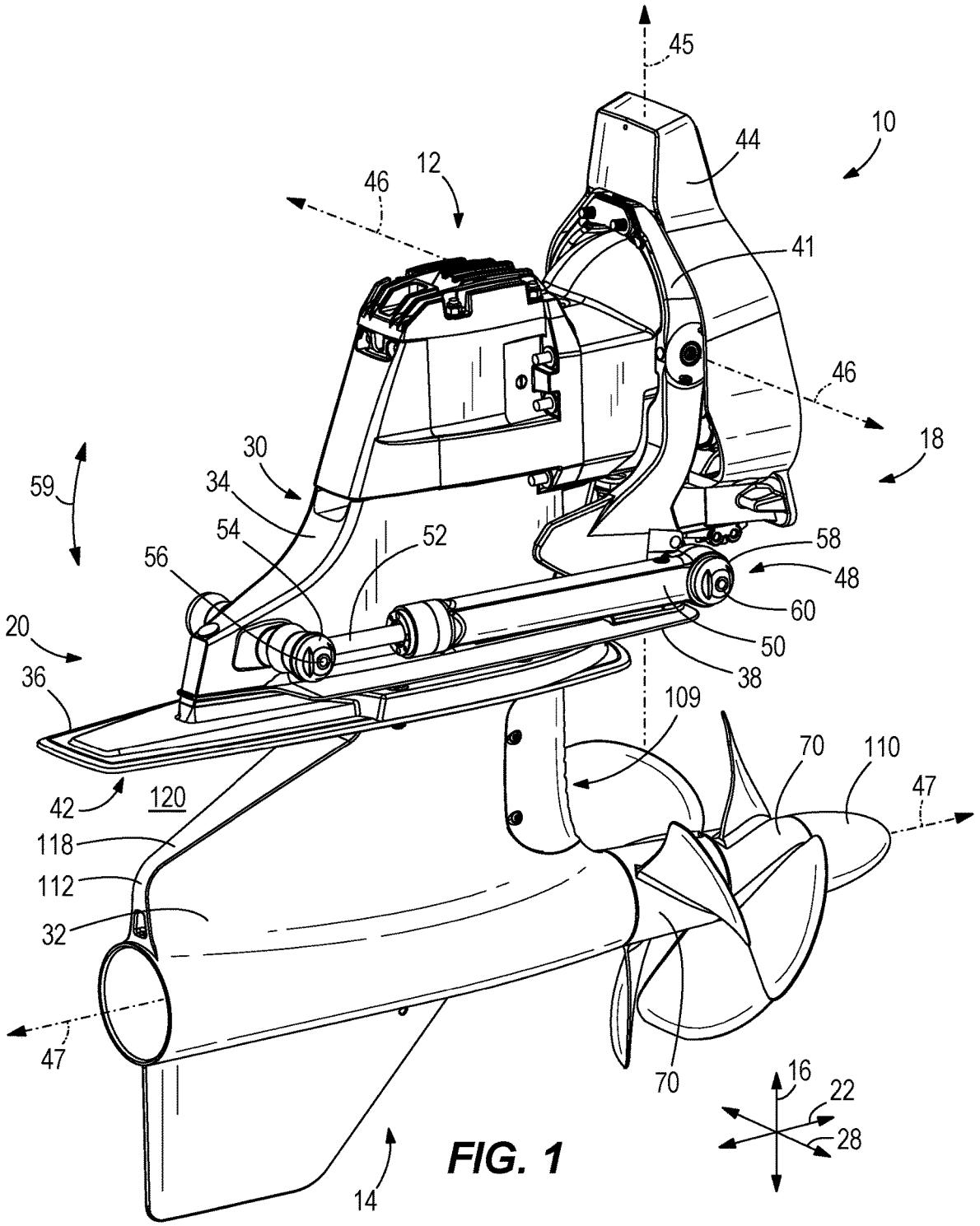
FIG. 1 is a perspective view of a stern drive according to the present disclosure.
Figure 2:
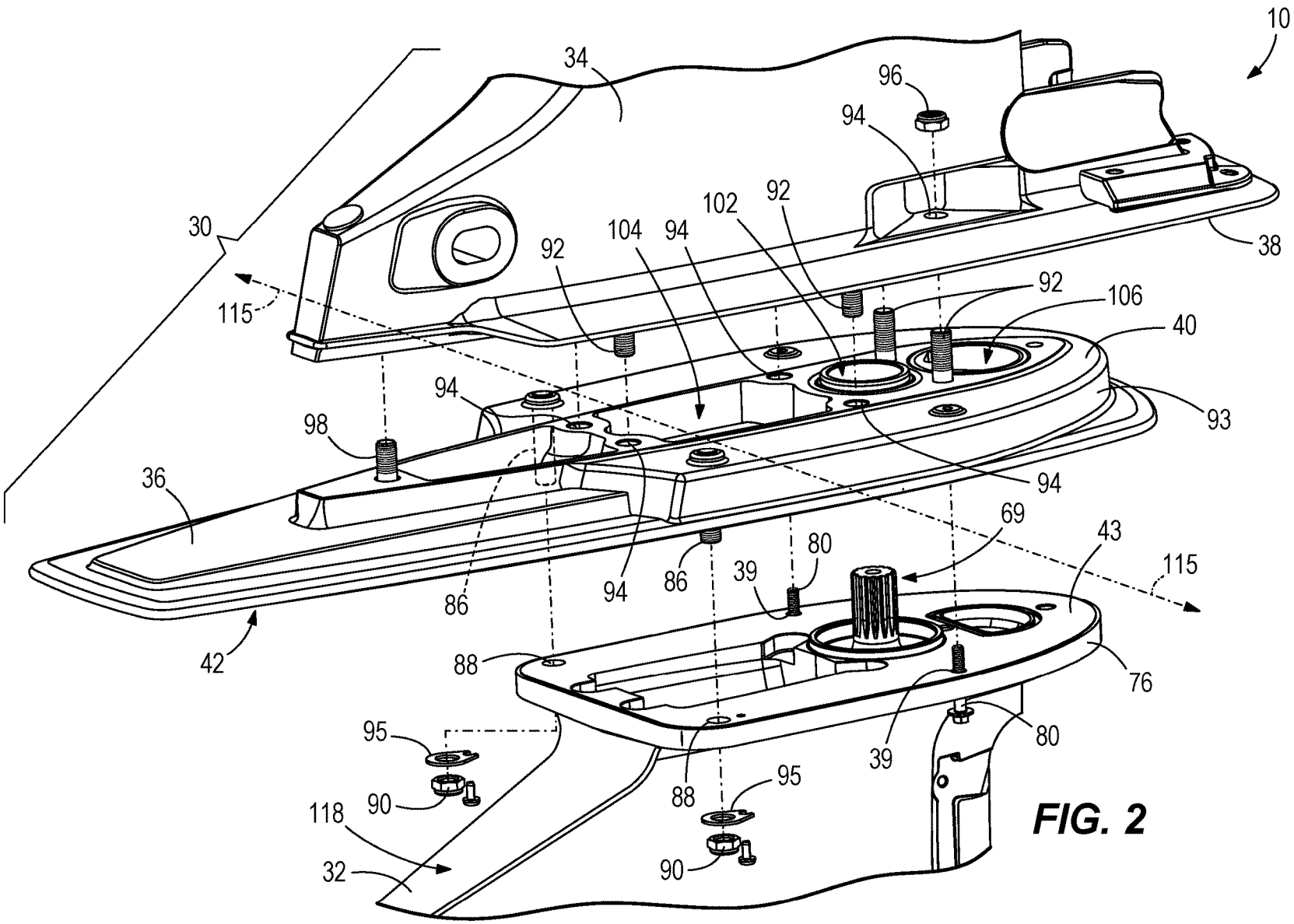
FIG. 2 is an exploded view looking down at the upper drive unit and lower gearcase of the stern drive.
Figure 3:
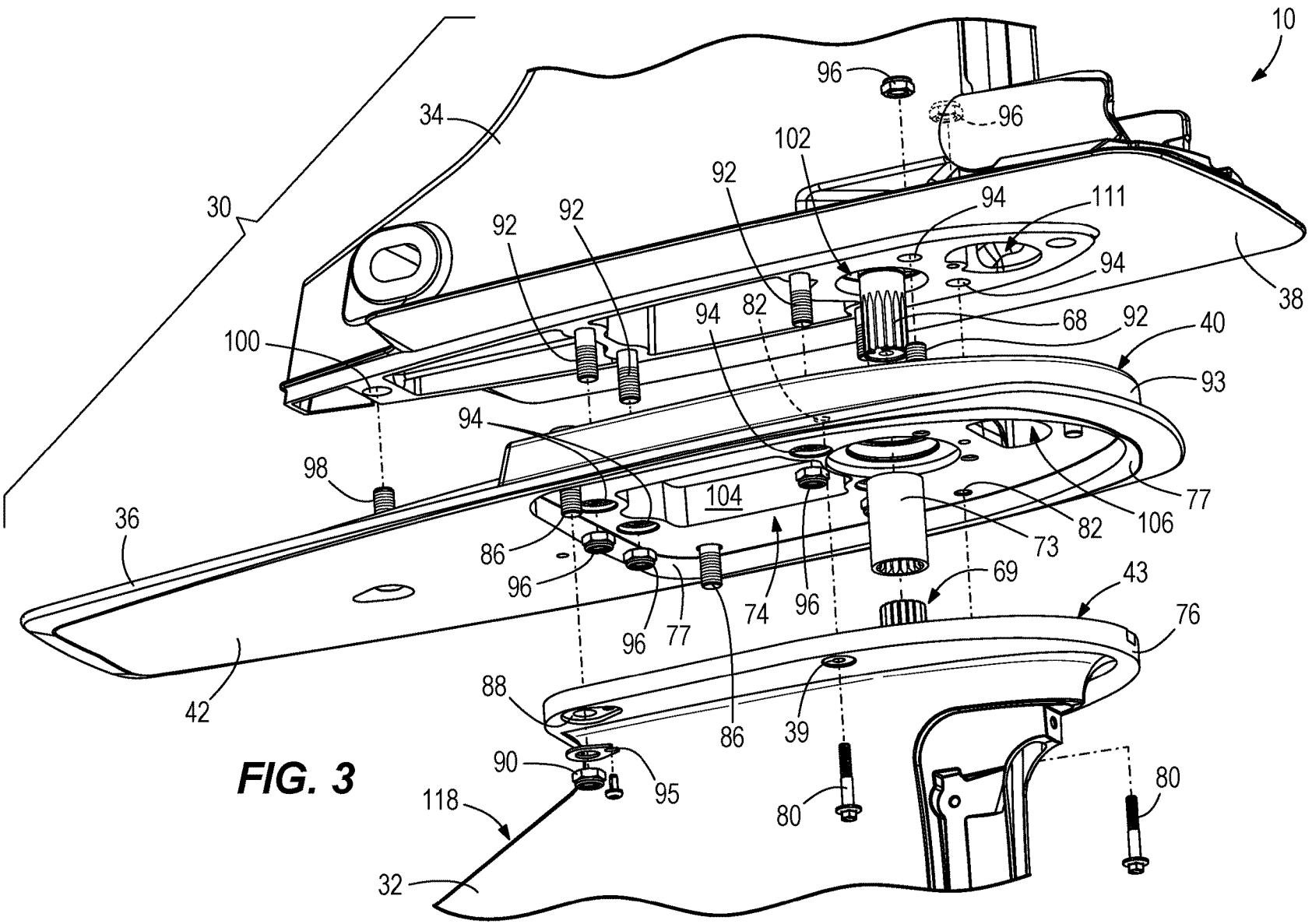
FIG. 3 is an exploded view looking up at the upper drive unit and lower gearcase.

FIGS. 1-3 depict a stern drive 10 according to the present disclosure. The stern drive 10 extends from top 12 to bottom 14 in an axial direction 16, from forward side 18 to rearward or trailing side 20 in a longitudinal direction 22 that is transverse to the axial direction 16, and from port side (see FIG. 1) to starboard side (the opposite side of FIG. 1, not shown) in a lateral direction 28 that is transverse to the axial direction 16 transverse to the longitudinal direction 22.

Figure 4:
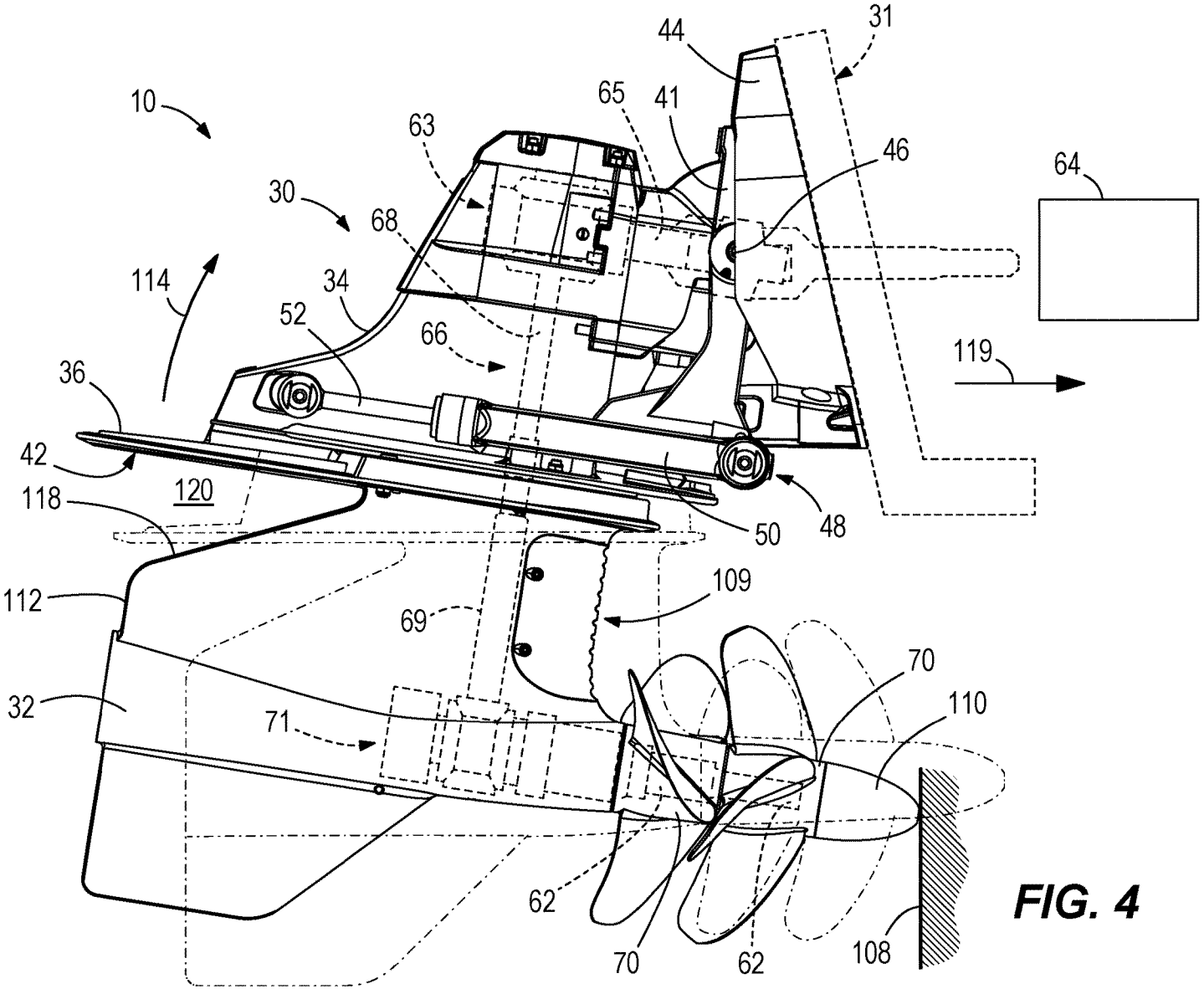
FIG. 4 is a side view of the stern drive as it impacts an underwater obstruction.

The stern drive 10 has an upper drive unit 30, which in use is coupled to the transom of a marine vessel 31 (see FIG. 4). The stern drive 10 also has a lower gearcase 32 that depends from the upper drive unit 30. The upper drive unit 30 generally includes a driveshaft housing 34 and an adapter plate 36. In examples not shown, the driveshaft housing 34 and adapter plate 36 could instead be more than two components or could instead be formed together as a monolithic component. In the illustrated example, as shown in dash-and-dot lines in FIGS. 2 and 3, the adapter plate 36 is sandwiched between the upper drive unit 30 and the lower gearcase 32. The driveshaft housing 34 has a lower mounting flange 38 (see FIG. 3) on which the adapter plate 36 is mounted. The adapter plate 36 has an upper mounting surface 40 (see FIG. 2) that faces and is coupled to the lower mounting flange 38, as will be further described herein below. The adapter plate 36 also has a lower mounting surface 42 (see FIG. 3) that faces away from the driveshaft housing 34, and to which an upper mounting flange 43 of the lower gearcase 32 is mounted, as will be further described herein below.

Referring to FIG. 1, the stern drive 10 has a conventional gimbal ring 41 and gimbal housing 44. The gimbal ring and gimbal housing 41, 44 facilitate steering motion of the stern drive 10 about an axially extending steering axis 45, particularly allowing the stern drive 10 to be steered in port and starboard directions with respect to the marine vessel 31. The gimbal ring and gimbal housing 41, 44 also allow for trimming motion of the stern drive 10 relative to the marine vessel 31 about a laterally extending trim axis 46, particularly permitting the stern drive 10 to be trimmed up and down with respect to the marine vessel 31. The type and configuration of the gimbal ring and gimbal housing 41, 44 can vary from what is shown and described. Suitable arrangements that facilitate both steering and trimming motion of the stern drive 10 are disclosed in the above-incorporated patents, and thus are not further herein described. See for example U.S. Pat. No. 9,481,439.

Referring to FIG. 1, the stern drive 10 has includes a trim actuator 48, which is configured to trim the stern drive 10 up and down relative to the marine vessel 31, as shown by double-headed arrow 59. The type and configuration of the trim actuator 48 can vary from what is shown and for example can include any other suitable conventional hydraulic systems and/or one or more conventional electric motors and/or a combination of these, and/or the like for causing the trimming motion shown at arrow 59. In the illustrated example, the trim actuator 48 is a hydraulic actuator, including port and starboard cylinders 50 and piston rods 52 extending from the cylinders 50. The outer ends 54 of the port and starboard piston rods 52 are coupled to the respective port and starboard rearward sides of the driveshaft housing 34 at a rearward pivot joint 56. The forward ends 58 of the port and starboard cylinders 50 are pivotally coupled to the port and starboard sides of the gimbal ring 41 at a forward pivot joint 60. Extension of the piston rods 52 from the cylinders 50 upwardly trims the upper drive unit 30 and lower gearcase 32 relative to the marine vessel 31. Retraction of the piston rods 52 into the cylinder 50 downwardly trims the upper drive unit 30 and lower gearcase 32 relative to the marine vessel 31. The trim actuator 48 further includes a conventional hydraulic pump and associated control valves (not shown) for supplying hydraulic fluid to the port and starboard cylinders 50. As is conventional, the piston rods 52 are placed under hydraulic pressure so they are caused to extend outwardly towards an outermost position relative to the cylinder 50, to thereby fully trim the stern drive 10 up relative to the marine vessel 31. The piston rods 52 are alternately placed under hydraulic pressure so they are retracted inwardly towards an innermost position relative to the cylinder 50 to thereby fully trim the stern drive 10 down relative to the marine vessel 31.

Referring to FIG. 4, the lower gearcase 32 supports a pair of counter-rotating dual propeller shafts 62. As is conventional, the propeller shafts 62 are caused to rotate about a longitudinal propeller shaft axis 47 (see FIG. 1) by an internal combustion engine and/or electric motor and/or any other suitable drive mechanism (shown schematically at 64 in FIG. 4). The drive mechanism 64 is operatively coupled to the propeller shafts 62 by a driveshaft 66, such that operation of the drive mechanism 64 causes rotation of the propeller shafts 62. The driveshaft 66 includes a longitudinally-extending first driveshaft portion 65 that extends into the driveshaft housing 34, an axially-extending second driveshaft portion 68 located in the driveshaft housing 34, and an axially-extending third driveshaft portion 69 located in the lower gearcase 32. A conventional gearset 63 operably connects the first driveshaft portion 65 to the second driveshaft portion 68. The second driveshaft portion 68 extends out of the lower mounting flange 38 of the driveshaft housing 34, as shown in FIG. 3. The third driveshaft portion 69 extends out of the upper mounting flange 43 of the lower gearcase 32, as shown in FIGS. 2 and 3. The outer ends of the second and third driveshaft portions 68, 69 are splined, and are operably coupled together by an internally splined connector sleeve 73, such that rotation of the second driveshaft portion 68 causes rotation of the third driveshaft portion 69. The axially-extending third driveshaft portion 69 is operably coupled to the propeller shafts 62 for example by another conventional bevel gearset 71, such that rotation of the third driveshaft portion 69 causes counter-rotation of the propeller shafts 62. Thus, operation of the drive mechanism 64 causes rotation of first, second and third driveshaft portions 65, 68, 69, which in turn causes counter-rotation of the dual propeller shafts 62.

Counter-rotating propellers 70 are located on the outer end of the dual propeller shafts 62, forwardly of the lower gearcase 32. The propellers 70 are caused to rotate by rotation of the propeller shafts 62, which thereby creates a propulsive force on the stern drive 10 and propels the marine vessel 31 in the body of water. This is conventionally referred to in the art as a "tractor-type" stern drive arrangement, wherein the propellers 70, which are often referred to as "pulling propellers", are located on the forward side of the lower gearcase 32, and wherein operation of the stern drive 10 in a forward gear causes the propellers 70 to effectively pull the marine vessel 31 in the surrounding body of water.

Referring to FIG. 3, the lower mounting surface 42 of the adapter plate 36 has a recess 74 into which the upper mounting flange 43 of the lower gearcase 32 is nested. Thus the outer peripheral sidewall 76 of the upper mounting flange 43 faces the inner peripheral sidewall 77 of the recess 74. The upper mounting flange 43 is fastened to the lower mounting surface 42 of the adapter plate 36, at least in part, by (A) a forward mounting joint and (B) a relatively more robust (i.e. mechanically stronger and thus more resistant to failure) rearward mounting joint. In particular, the forward mounting joint is formed by port and starboard fasteners 80 that extend through the port and starboard through-bores 39 in the upper mounting flange 43 and into threaded engagement with port and starboard threaded holes 82 in the adapter plate 36, respectively. The rearward mounting joint is formed by relatively more robust port and starboard threaded studs 86 that extend from the lower mounting surface 42 of the adapter plate 36 and through port and starboard through-bores 88 in the upper mounting flange 43. Fastener nuts 90 and locking washers 95 and are threaded onto the ends of the port and starboard threaded studs 86 to thereby fasten the lower gearcase 32 to the adapter plate 36.

Referring to FIGS. 2 and 3, the adapter plate 36 is fastened to the driveshaft housing 34, in particular, via threaded studs 92 that extend from a raised pedestal 93 on the lower mounting flange 38 and into corresponding through-bores 94 in the adapter plate 36 and alternately from the adapter plate 36 into corresponding through-bores 94 in the raised pedestal 93. Fastener nuts 96 are threaded onto the ends of the threaded studs 92 and registered in sunken recesses on through-bores 94 to thereby secure the adapter plate 36 to the driveshaft housing 34. An additional threaded stud 98 located rearwardly of the threaded studs 92 extends from the upper mounting surface 40 of the adapter plate 36 and is engaged in a threaded bore 100 in the driveshaft housing 34 to further fasten the components together. The manner in which the adapter plate 36 is fastened to the driveshaft housing 34 can vary from what is shown and described.

Referring to FIGS. 2 and 3, the adapter plate 36 has a centrally-located driveshaft passageway 102 in which the second and third driveshaft portions 68, 69 are located. The noted forward mounting joint is disposed longitudinally and laterally alongside the driveshaft 66. In particular, the forward port and starboard threaded holes 82 in the adapter plate 36 and the respective fasteners 80 are diametrically opposed to each other relative to the passageway 102, i.e., on the port and starboard sides of the driveshaft 66, respectively. The adapter plate 36 also has a second passageway 104 through which exhaust gases from the stern drive 10 are conveyed from the upper drive unit 30 to the lower gearcase 32. The noted robust rearward mounting joint is located rearwardly of the driveshaft 66 and rearwardly of the second passageway 104. In particular, the rearward port and starboard threaded studs 86 and port and starboard through-bores 88 are located rearwardly of the second passageway 104, and on the port and starboard sides of the second passageway 104, respectively. A third passageway 106 in the adapter plate 36 is located forwardly of the driveshaft 66 and is for conveying cooling water through the stern drive 10, in a conventional arrangement, particularly from an inlet 109 (see FIG. 1) on the lower gearcase 32 to an inlet 111 (see FIG. 3) formed in the lower mounting flange 38 of the driveshaft housing 34. The third passageway 106 is located forwardly of the forward mounting joint.

Referring to FIGS. 1-3, the lower gearcase 32 has a trailing end surface 118 that is angled relative to (i.e., extends transversely to) the lower mounting surface 42 and further has a trailing end surface 112 that extends generally perpendicularly to the lower mounting surface 42. The lower mounting surface 42 and trailing end surface 112 meet at a rounded corner. There is a three-dimensional space or gap 120 (see FIG. 4) located (longitudinally, axially, and transversely) between the trailing end of the lower mounting surface 42 and the angled trailing end surface 118. The angled trailing end surface 118 and the gap 120 facilitate pivoting movement of the lower gearcase 32 relative to the upper drive unit 30, as shown in FIG. 5, and subsequent uncoupling and separation of the lower gearcase 32 from the upper drive unit 30, as shown in FIG. 6, as will be further described herein below.

Figure 5:
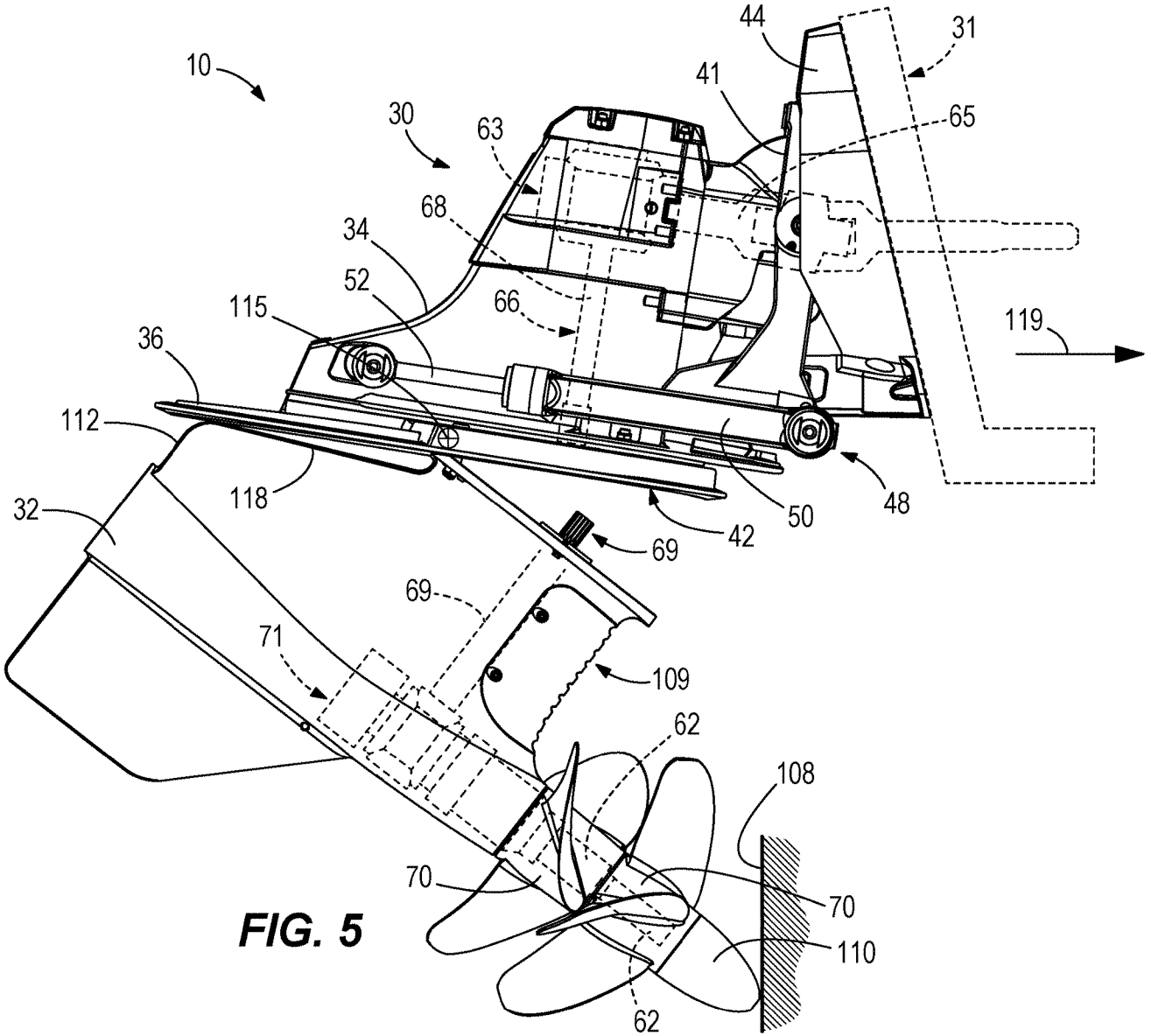
FIG. 5 is a side view of the stern drive immediately after it impacts an underwater obstruction, showing how the lower gearcase pivots rearwardly relative to the upper drive unit until a trailing end surface of the lower gearcase impacts a lower mounting surface of the upper driver unit.
Figure 6:
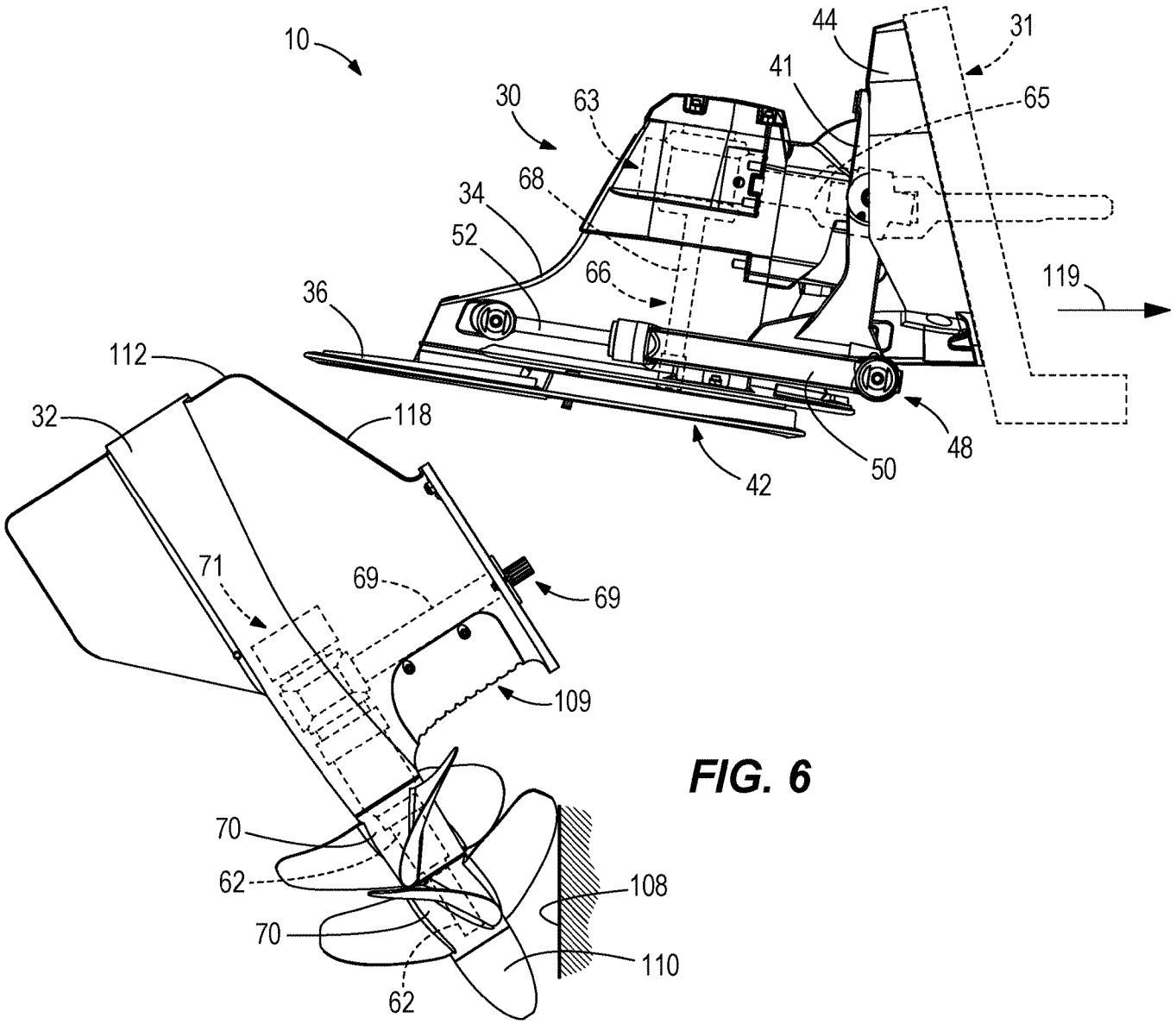
FIG. 6 is a side view of the lower gearcase separated from the upper drive unit after impact of the trailing end surface on the lower mounting surface and uncoupling of the lower gearcase from the upper drive unit.

FIGS. 4-6 depict an initial impact of the stern drive 10 on an underwater obstruction 108, particularly as the stern drive 10 and marine vessel 31 are moving forwardly. The type and configuration of the underwater obstruction 108 can vary, and for example could include a reef, bedrock, and/or any other sizeable underwater impediment. FIGS. 4-6 depict, impact of the nose cone 110 of the dual propeller shafts 62 on the underwater obstruction 108; however the concepts of the present disclosure are also applicable in other collisions, for example anywhere along the leading edge of the lower gearcase 32.

Referring to FIG. 4, the initial impact with the underwater obstruction 108 causes the stern drive 10 to pivot about the trim axis 46, as shown at arrow 114, which pivoting movement is permitted by an outward extension movement of the piston rods 52 from the cylinders 50.

Referring to FIG. 5, either simultaneously upon impact and/or during or after the above-noted pivoting movement of the lower gearcase 32 shown in FIG. 4, the forward mounting joint is caused to fail, for example by shearing of the fasteners 80 and/or stripping of the threaded connection between the fasteners 80 and the corresponding holes 82. Failure of the forward mounting joint will typically occur when the underwater obstruction 108 is impacted with significant force, for example a force large enough to have otherwise damaged the stern drive 10, but for the noted failure of the forward mounting joint. As described herein above, the rearward mounting joint is more robust than the forward mounting joint and is thus it is configured to remain intact even when the forward mounting joint is caused to fail, which facilitates subsequent pivoting movement of the lower gearcase 32 about a lateral pivot axis 115, as shown in FIG. 5. In particular, the lateral pivot axis 115 is defined by the port and starboard threaded studs 86. The port and starboard threaded studs 86 are more robust than the port and starboard fasteners 80 (e.g. have larger size and/or are made of more resilient material, for example a stronger metal) and less susceptible to failure than the port and starboard fasteners 80. Also, location of the port and starboard studs 86 rearwardly of the driveshaft 66 and rearwardly of the port and starboard fasteners 80 is further from the point of impact on the forward side 18 of the stern drive 10, and thus causes the rearward mounting joint to be less likely to fail under the initial impact force of the lower gearcase 32 striking the underwater obstruction 108. As mentioned, failure of the forward mounting joint upon or after impact, advantageously results in a pivoting movement of the lower gearcase 32 with respect to the upper drive unit 30, particularly about the rearward mounting joint, and more particularly about the lateral pivot axis 115 defined by the port and starboard threaded studs 86.

Referring to FIG. 5, shearing of the forward mounting joint and retention of the rearward mounting joint facilitates pivoting of the lower gearcase 32 until the trailing end surface 118 impacts the trailing end of the lower mounting surface 42, which impact force causes the rearward mounting joint to fail, and thus results in complete separation of the lower gearcase 32 from the upper drive unit 30, as shown in FIG. 6. That is, the rearward mounting joint is sized and located such that the force of impact between the lower gearcase 32 and the adapter plate 36 along the trailing end surface 118 shears the rearward port and starboard threaded studs 86 and/or strips the threaded connection between the studs 86 and the through-bores 88, and/or otherwise cases the rearward mounting joint to fail, thus resulting in separation of the lower gearcase 32 from the upper drive unit 30. That is, the size and location of the studs 86 is such the studs are designed to fail under the force of impact shock that occurs between the lower gearcase 32 and trailing end of the adapter plate 36. The internally splined connector sleeve 73 facilitates separation of the outer ends of the second and third driveshaft portions 68, 69 when the noted rearward mounting joint fails.

Advantageously, because the trailing end of the adapter plate 36 is located above and rearwardly of the rearward mounting joint, upon failure of the rearward mounting joint the lower gearcase 32 pivots about the rounded corner between the lower mounting surface 42 and trailing end surface 112, and is forced downwardly and rearwardly of the remainder of the stern drive 10, as shown in FIG. 6, thus preventing it from traveling upward out of the body of the water. This causes a safer separation of the lower gearcase 32 from the rest of the stern drive 10 and advantageously protects the upper drive unit 30 of the stern drive 10 from being damaged by the impact with the underwater obstruction 108. It also prevent the lower gearcase 32 from moving upwardly out of the body of water and potentially injuring someone.

The present disclosure thus provides an improved stern drive 10 wherein the upper drive unit 30 and the lower gearcase 32 are specially configured such that when the forward side 18 of the stern drive 10 impacts an underwater obstruction 108, particularly along the lower gearcase 32, the lower gearcase 32 is caused to rearwardly pivot relative to the upper drive unit 30 until the trailing end surface 118 of the lower gearcase 32 impacts the lower mounting surface 42, which thereby causes the lower gearcase 32 to completely uncouple from the upper drive unit 30. The upper drive unit 30, the lower gearcase 32, and the trim actuator 48 are specially configured such that when the forward side 18 of the stern drive 10 impacts the underwater obstruction 108, particularly along the lower gearcase 32, the upper drive unit 30 is initially caused to trim relative to the marine vessel 31 and the lower gearcase 32 is caused to pivot relative to the upper drive unit 30, until the trailing end surface 118 impacts the lower mounting surface 42, which thereby causes the lower gearcase 32 to completely uncouple from the upper drive unit 30. When the forward side 18 of the stern drive 10 impacts the underwater obstruction 108, particularly along the lower gearcase 32, the upper drive unit 30 is first caused to trim up relative to the marine vessel 31, which in turn causes the piston rods 52 to extend outwardly to the outermost position, and thereafter the trailing end surface 118 impacts the lower mounting surface 42, which causes the lower gearcase 32 to completely uncouple from the upper drive unit 30. Advantageously the lower mounting surface 42 extends rearwardly of the lower gearcase 32, so that when the trailing end surface 118 impacts the lower mounting surface 42, the lower gearcase 32 is forced downwardly relative to the marine vessel 31 and more specifically is prevented from moving upwardly out of the water.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the appended claims.

What is claimed is:

1. A stern drive for propelling a marine vessel in water, the stern drive comprising:

an upper drive unit having a lower mounting surface;

a lower gearcase coupled to the lower mounting surface and having a trailing end surface that is angled relative to the lower mounting surface; and a propeller shaft extending forwardly from the lower gearcase and being configured to rotate a propeller for pulling the marine vessel in the water;

wherein the upper drive unit and the lower gearcase are configured such that when a forward side of the lower gearcase impacts an underwater obstruction, the lower gearcase is caused to rearwardly pivot relative to the upper drive unit until the trailing end surface impacts the lower mounting surface, which thereby causes the lower gearcase to completely uncouple from the upper drive unit.

2. The stern drive according to claim 1, further comprising a trim actuator configured to trim the upper drive unit relative to the marine vessel, wherein the upper drive unit, the lower gearcase, and the trim actuator are configured such that when the forward side of the lower gearcase impacts the underwater obstruction, the upper drive unit is caused to trim up relative to the marine vessel and the lower gearcase is caused to rearwardly pivot relative to the upper drive unit, until the trailing end surface impacts the lower mounting surface, which thereby causes the lower gearcase to completely uncouple from the upper drive unit.

3. The stern drive according to claim 2, wherein the trim actuator is a hydraulic actuator comprising a cylinder and a piston rod extending from the cylinder, wherein the piston rod is extended outwardly towards an outermost position relative to the cylinder to thereby trim the stern drive up relative to the marine vessel and wherein the piston rod is retracted inwardly towards an innermost position relative to the cylinder to thereby trim the stern drive down relative to the marine vessel.

4. The stern drive according to claim 3, wherein the when the forward side of the lower gearcase impacts the underwater obstruction, the upper drive unit is caused to trim up relative to the marine vessel, which in turn causes the piston rod to extend outwardly to the outermost position, and wherein thereafter the trailing end surface impacts the lower mounting surface, which thereby causes the lower gearcase to completely uncouple from the upper drive unit.

5. The stern drive according to claim 4, wherein the lower mounting surface extends rearwardly of the lower gearcase so that when the trailing end surface impacts the lower mounting surface, the lower gearcase is forced rearwardly and downwardly relative to the marine vessel and more specifically is prevented from moving upwardly out of the water.

6. The stern drive according to claim 1, wherein the upper drive unit comprises a driveshaft housing and an adapter plate on the driveshaft housing, wherein the adapter plate is sandwiched between the upper drive unit and the lower gearcase.

7. The stern drive according to claim 6, wherein the driveshaft housing comprises a lower mounting flange, and wherein the adapter plate comprises the lower mounting surface and further comprises an upper mounting surface that faces the lower mounting flange.

8. The stern drive according to claim 7, wherein the lower gearcase comprises an upper mounting flange that is fastened to the lower mounting surface.

9. The stern drive according to claim 8, wherein the lower mounting surface comprises a recess into which the upper mounting flange is nested.

10. The stern drive according to claim 8, wherein the lower gearcase is fastened to the adapter plate by a forward mounting joint comprising port and starboard fasteners that extend through the upper mounting flange and into port and starboard threaded holes in the adapter plate, respectively.

11. The stern drive according to claim 10, wherein the lower gearcase is also fastened to the adapter plate by a rearward mounting joint comprising port and starboard threaded studs extending from the lower mounting surface and through port and starboard through-bores in the upper mounting flange.

12. The stern drive according to claim 11, further comprising fastener nuts that are threaded onto the port and starboard threaded studs to fasten the lower gearcase to the adapter plate.

13. The stern drive according to claim 11, wherein the adapter plate defines first passageway through which a driveshaft of the stern drive extends, and wherein the port and starboard through-bores in the adapter plate are diametrically opposed to each other relative to the passageway, on the port and starboard sides of the stern drive, respectively.

14. The stern drive according to claim 13, wherein the adapter plate defines a second passageway through which exhaust from the stern drive is conveyed from the upper drive unit to the lower gearcase, and wherein the port and starboard threaded studs are located rearwardly of the second passageway and on the port and starboard sides of the stern drive, respectively.

15. The stern drive according to claim 11, wherein the port and starboard threaded studs define a pivot axis about which the lower gearcase is caused to rearwardly pivot relative to the upper drive unit when the forward side of the lower gearcase impacts the underwater obstruction.

16. The stern drive according to claim 6, wherein the adapter plate comprises the lower mounting surface and wherein the lower mounting surface extends above and rearwardly of the trailing end surface of the lower gearcase and as such is configured to cause the lower gearcase to move downwardly upon separation from the upper drive unit and more particularly prevents the lower gearcase from traveling upwardly out of the water.

17. A stern drive for propelling a marine vessel in water, the stern drive extending from top to bottom in an axial direction, from forward side to trailing side in a longitudinal direction that is transverse to the axial direction, and from port side to starboard side in a lateral direction that is transverse to the axial direction and transverse to the longitudinal direction, the stern drive comprising:

an upper drive unit having a lower mounting surface;

a lower gearcase coupled to the lower mounting surface and having a trailing end surface that is angled relative to the lower mounting surface and extends transversely relative to the axial and longitudinal directions; and a propeller shaft extending forwardly from the lower gearcase in the longitudinal direction and being configured to rotate a propeller for pulling the marine vessel in the water;

wherein the lower gearcase is mounted to the upper drive unit by a forward mounting joint and a trailing mounting joint located rearwardly of the forward mounting joint in the longitudinal direction; and wherein the upper drive unit and the lower gearcase are configured such that when the forward side of the lower gearcase impacts an underwater obstruction, the forward mounting joint is configured to fail, thus permitting the lower gearcase to rearwardly pivot relative to the upper drive unit about a pivot axis defined by the trailing mounting joint, until the trailing end surface impacts the lower mounting surface, which thereby breaks the trailing mounting joint and allows the lower gearcase to completely uncouple from the upper drive unit.

18. The stern drive according to claim 17, further comprising a trim actuator configured to trim the stern drive relative to the marine vessel, wherein the upper drive unit, the lower gearcase, and the trim actuator are configured such that when the forward side of the lower gearcase impacts the underwater obstruction, the upper drive unit is caused to trim up relative to the marine vessel about a trim axis and the lower gearcase is caused to rearwardly pivot relative to the upper drive unit about the trailing mounting joint, until the trailing end surface impacts the lower mounting surface, which thereby breaks the trailing mounting joint and so causes the lower gearcase to completely uncouple from the upper drive unit.

19. The stern drive according to claim 18, further comprising a gimbal ring and gimbal housing for coupling the upper drive unit to the marine vessel, wherein the trim actuator is a hydraulic actuator comprising a cylinder and a piston rod extending from the cylinder, wherein the piston rod is extended outwardly towards an outermost position relative to the cylinder to thereby trim the stern drive up about the trim axis and wherein the piston rod is retracted inwardly towards an innermost position relative to the cylinder to thereby trim the stern drive down about the trim axis, and wherein a first end of the cylinder and piston rod is coupled to the gimbal ring and a second end of the cylinder and piston rod is coupled to the upper drive unit, rearwardly of the lower gearcase.

* * * * *